US007780509B1

(12) United States Patent
Hoaks

(10) Patent No.: US 7,780,509 B1
(45) Date of Patent: Aug. 24, 2010

(54) QUICK-INSTALL FOUNDATION VENT

(76) Inventor: John Charles Hoaks, P.O. Box 248, Florence, OR (US) 97439

( * ) Notice: Subject to any disclaimer, the term of this patent is extended or adjusted under 35 U.S.C. 154(b) by 470 days.

(21) Appl. No.: 11/565,110

(22) Filed: Nov. 30, 2006

(51) Int. Cl.
*F24F 7/00* (2006.01)

(52) U.S. Cl. ..... 454/274; 454/271

(58) Field of Classification Search ..... 454/271–278
See application file for complete search history.

(56) References Cited

U.S. PATENT DOCUMENTS

| | | | | |
|---|---|---|---|---|
| 4,469,018 | A | 9/1984 | Taulman | |
| 4,821,628 | A | 4/1989 | Sarazen | |
| 5,444,947 | A | 8/1995 | Miller | |
| 5,487,701 | A | 1/1996 | Schedegger | |
| 5,496,213 | A | 3/1996 | Miller | |
| 5,588,908 | A * | 12/1996 | Camarota | 454/78 |
| 6,302,785 | B1 | 10/2001 | McKinney | |
| 6,669,554 | B1 | 12/2003 | Tregidga | |
| 7,040,979 | B1 * | 5/2006 | Betz | 454/271 |
| 7,097,557 | B2 | 8/2006 | Kutschman | |

* cited by examiner

*Primary Examiner*—Steve McAllister
*Assistant Examiner*—Helena Kosanovic
(74) *Attorney, Agent, or Firm*—Bert P. Krages, II

(57) ABSTRACT

A foundation vent comprising a front frame and resiliently-flexible clips with tabs at their ends. The foundation vent can be quickly installed within a foundation opening by flexing the clips, placing them into the opening, and pushing the front frame until it seats against the exterior of a foundation wall. At this point, the tabs of the clips will have protruded past the interior face of the foundation wall allowing the clips to return to their unflexed state and causing the tabs to secure against the interior face of the foundation wall.

15 Claims, 7 Drawing Sheets

QUICK-INSTALL FOUNDATION VENT

CROSS-REFERENCED TO RELATED APPLICATIONS

None

FEDERALLY SPONSORED RESEARCH

No

BACKGROUND OF THE INVENTION

Enclosed crawlspaces beneath buildings usually have soil floors and are contained by a concrete or masonry wall that extends down to the footings. Moisture is a concern in crawlspaces because it can create environmental conditions that are favorable for the growth of mildew, molds, and other kinds of fungi. One source of moisture in crawlspaces is the water vapor that escapes from the soil. Leaks or drainage that infiltrate the crawlspace are another common source of moisture. At certain humidity levels, the moisture in the crawlspace atmosphere will condense within the crawlspace. Standing condensate creates a nuisance and can foster the growth of unhealthy microorganisms such as *Legionella* bacteria. Condensed moisture also absorbs into porous surfaces and fosters rot that results in the deterioration of structural components such as wooden joists. Even when the moisture does not result in structural deterioration and health problems, it can lead to the creation of undesirable musty odors.

To reduce the humidity levels in crawlspaces to levels that discourage the condensation of moisture, it is desirable to ventilate the crawlspace. Ventilation, in addition to reducing moisture levels, serves to vent out other gases such as radon and vapors from termite treatment. To promote ventilation, it is common to provide ventilation openings in the wall or foundation surrounding the crawlspace. For example, many building codes specify that the walls surrounding crawlspaces must have ventilation openings of not less than 1 square foot for each 150 square feet of crawlspace area.

It is very common to cover ventilation openings with foundation vents that have a grid or bars at the exterior face to exclude debris and vermin such as mice and insects. Most foundation vents are installed in openings that measure 8 inches high by 16 inches wide, which is the space that would be occupied by a standard masonry block. Some foundation vents feature a shutter which can be closed to seal the vent during cold weather. Foundation vents with shutters come in manually-operated and automatic versions, the shutters in the automatic versions generally being opened and closed through the action of a bi-metal coil that operates without electricity. In addition, some foundation vents incorporate an electrically-powered fan to force air to vent from the crawlspace.

There are various ways of installing foundation vents depending on their design, A common way of installing vents is by applying a bed of cement, caulking, or other adhesive at the bottom of the opening in the foundation, setting the vent into the opening, and then securing the vent edges with a surface coat of the cement, caulking, or other adhesive. Another means of securing foundation vents is to drill holes into the foundation wall and then secure the vent with nails, screws, or wall anchors. Some foundation vents are secured to foundation openings by tabs that are either pressed against or nailed to the circumferential face of the opening. Such means of securing vents require the installer to spend time and use tools to install a vent. Vents which require the use of adhesives or the creation of holes in the foundation wall also can result in unsightly marring of the foundation. Thus, there is a need for a foundation vent that can be quickly installed without tools, adhesives, or the need to use fasteners such as screws and nails.

SUMMARY OF THE INVENTION

The present invention comprises a foundation vent that can be quickly installed without the use of tools or adhesives. The vent assembly has a front frame that engages the exterior face of the foundation wall when the assembly is pushed into the ventilation opening; a grid that serves to screen the opening, and two rear-facing clips with tabs that extend past and flexibly engage the interior face of the foundation wall to secure the vent assembly to the foundation wall. In the preferred embodiment, the front frame has slots near the edge of the right and left sides of the front frame into which the clips can be inserted prior to installation. This allows the installer to select rear-facing members of a depth appropriate for the foundation wall into which the assembly will be installed. For example, clips of differing length can be premanufactured to enable assemblies to be installed into ventilation openings in walls of standard thicknesses such as the 8-inch foundation wall commonly encountered. In addition, manufacturing the clips separately from the front frame allows the assembly to shipped in a compact dissembled state at a lower packaging and shipping cost.

Installation of the present invention is a straightforward process. The installer determines the thickness of the foundation wall at the ventilation opening and selects two clips of the appropriate length. Each clip has a first end that is set at a slight angle from the central reach of the clip and a second end that forms a tab set at an approximately perpendicular angle from the central reach. The first ends of the clips are inserted into slots in the front frame. A projection inside each slot engages a recess in the end of a clip and secures the clip to the frame. The installer then flexes the clips towards each other so that they fit within the ventilation opening. The assembly is pushed into the ventilation opening until the outer flange on the frame rests against the exterior face of the foundation wall. At this point, the clips will flex away from each other causing the tabs to engage against the interior face of the foundation wall and secure the vent.

DETAILED DESCRIPTION OF THE PREFERRED EMBODIMENT

Figure 1:
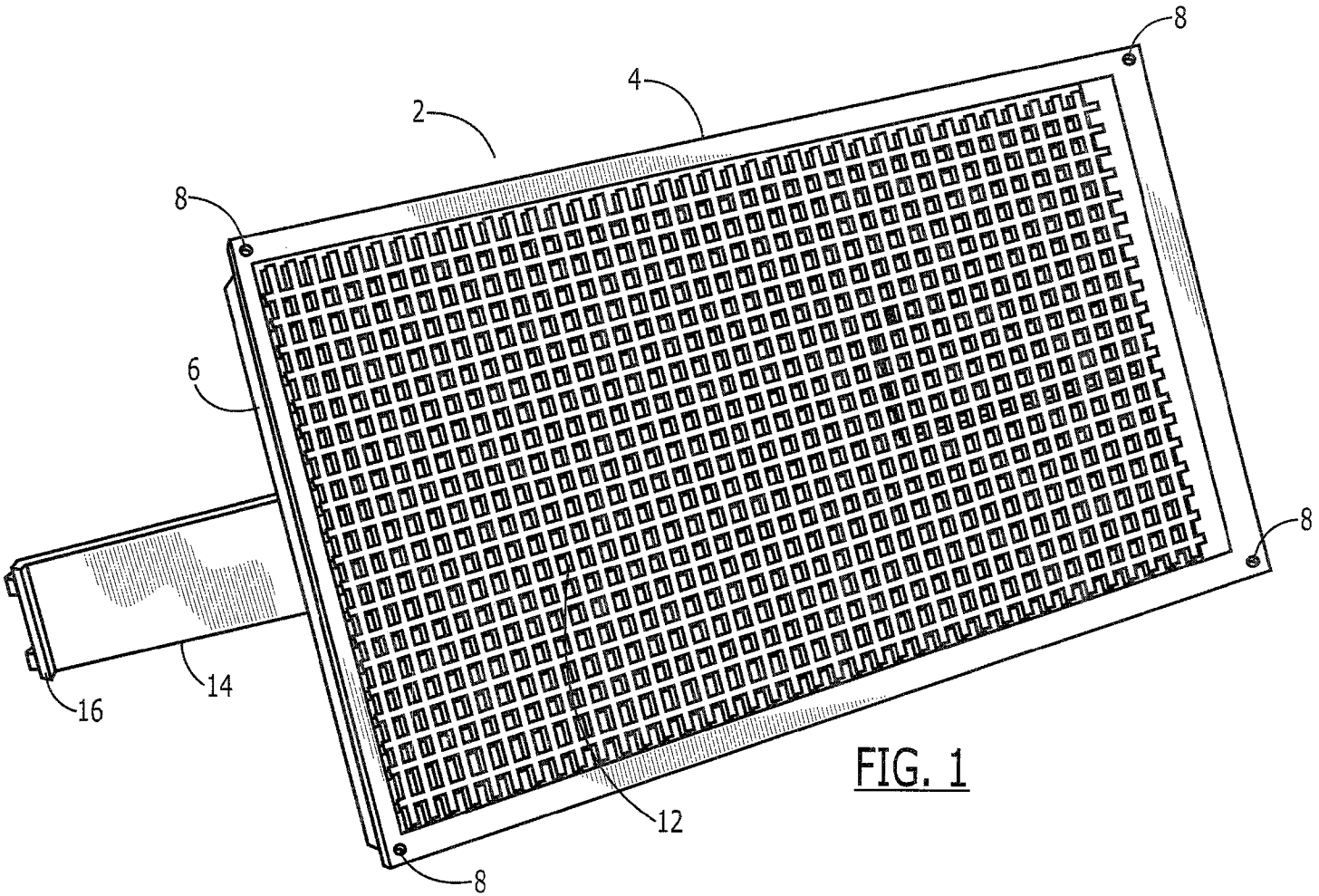
FIG. 1 is a front perspective view of a foundation vent embodying the invention.
Figure 2:
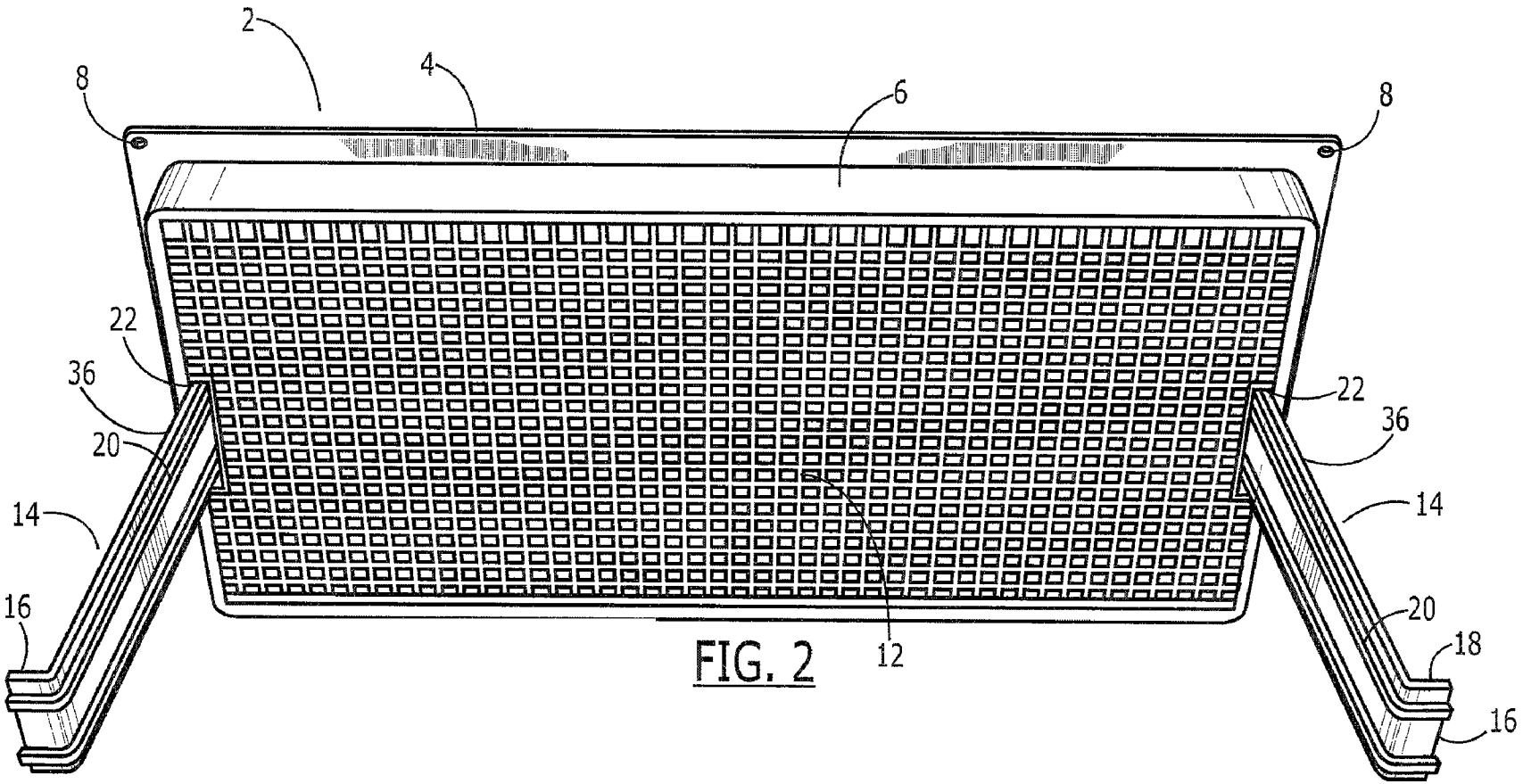
FIG. 2 is a rear perspective view of a foundation vent embodying the invention.

As shown in FIGS. 1 and 2, the preferred embodiment of the foundation vent of the present invention comprises a rectangular front frame 2 having a peripheral front flange 4 and a peripheral skirt 6. The central portion of the front frame 2 is provided with a integral screen portion 12. In the preferred embodiment, the integral screen portion 12 is connected to the rear portion of the skirt 6 so that a recessed space is created between the rear and front faces of the skirt which can receive a plugging member (not shown) to seal the front frame 2 during cold weather. Two clips 14 having a proximal end 36 and distal end 16 are attached to the rear face of the front frame 2 by inserting the proximal ends 36 into slots 22 located on the front frame as shown in FIG. 2. The distal ends 16 of the clips 14 art set at an angle that is substantially parallel to the front flange 4 and have an inner face 18 that extends beyond the edge of the peripheral skirt 6. Holes 8 are provided at the corners of the peripheral front flange 4 so that the front flange 2 may be optionally secured to a foundation wall with screws, nails, or similar fasteners if desired. Front frame 2 can be made of any suitable material that is weather resistant and sufficiently rigid to support the front frame inside a ventilation opening. Examples of suitable materials include plastics such as polypropylene and nylon and metals such as aluminum and galvanized steel but the preferred embodiment is made of injection-molded plastic.

Figure 3:
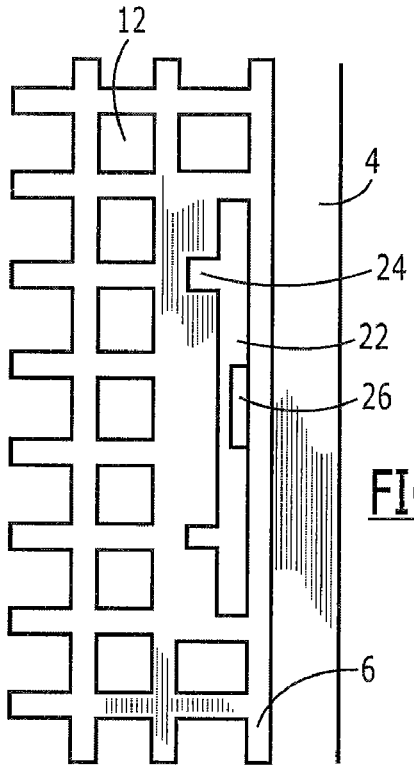
FIG. 3 is a rear view detailing one of the slots in the front frame.

FIG. 3 shows a slot 22 set adjacent to the skirt 6. In the preferred embodiment, two slots 22 are set into the opposed short sides of the front frame 2. The purpose of slot 22 is to receive and retain the proximal end 36 of a clip 14 (not shown in FIG. 3). The slot 22 has two small indentations 24 set along the portion of the slot adjacent to the screen portion 12. A small protrusion 26 extends from the inner portion of the skirt 6 into the slot 22.

Figure 4A:
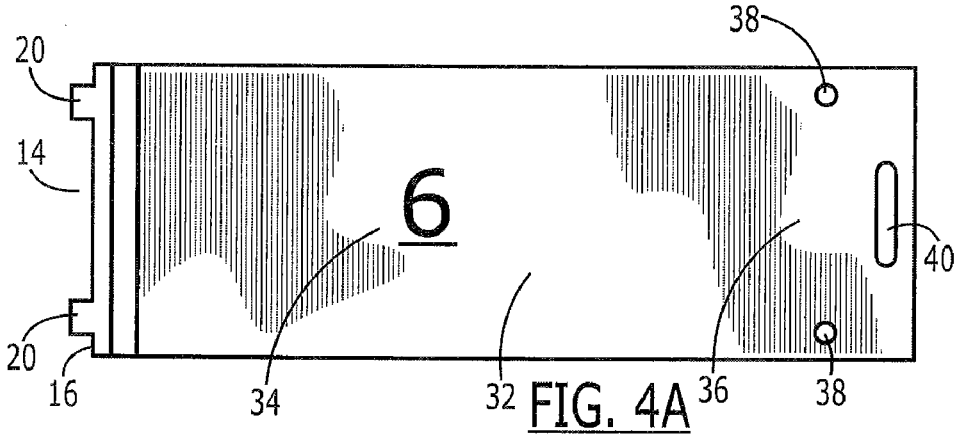
FIG. 4A is a side view of a clip.

FIG. 4A shows the face of clip 14 that faces outwards from the front frame 2 when installed into a slot 22. The clip 14 has a proximal end 36, distal end 16, and a central portion 32. The proximal end 36 is designed to fit into a slot 22 (depicted in FIGS. 2 and 3) and has a small recess 40 into which the protrusion 26 shown in FIG. 3 snaps into place when the proximal end 36 is fully inserted to slot 22. The proximal end also has a pair of ridges 20 that engage with the small indentations 24 (also depicted in FIG. 3). The purpose of the small indentations 24 and the ridges 20 is to ensure that the clips 14 are installed so that their distal ends 16 face outwards. The proximal end has two protuberances 38 that act as stops to further limit the depth at which a clip 14 can be inserted into a slot 22. The proximal end may be set at a slight angle to the central portion 32 so that the clip 14 splays outward slightly from the front frame 2 when the clips 14 are installed into the slots 22 (see FIG. 2). The distal ends 16 are angled sharply from the central portion 32 such that the distal ends 16 are positioned substantially parallel to the front flange 2 when the proximal ends 32 are inserted into slots 22 (depicted in FIG. 2). It is noted that the angle and lengths of the central portions 32 and distal ends 16 need only be sufficient to firmly secure the assembly to the wall and that considerable latitude should be given to the term substantial as used in this context (e.g., 90 degrees±20 degrees).

Figure 4B:
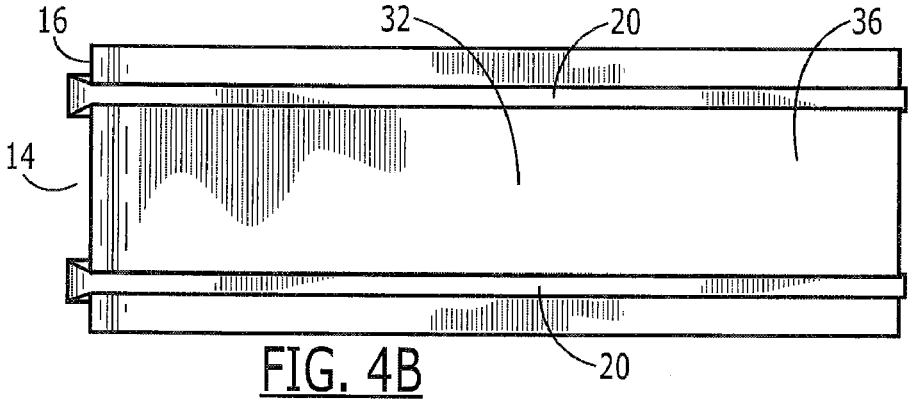
FIG. 4B is a side view showing another face of a clip.

FIG. 4B Clip shows the face of a clip 14 that faces inward when installed into the front frame 2. Note that the ridges 20 extend longitudinally along the central portion 32 and the distal end 16 and serve the additional purpose of providing structural reinforcement to the clip 14.

The clips 14 can be made of any suitable material that has a sufficient flexible resilience to withstand being flexed about 15 degrees inwards once installed into a slot 22 and has a sufficient yield strength to return to the unflexed state once the flexing force is relieved. Examples of suitable materials include plastics such as polyethylene and nylon and metals such as aluminum and galvanized steel. In the preferred embodiment, the clips are made of injection-molded plastic. Depending on the depth of the foundation wall into which the foundation vent will be installed, clips 14 can be selected of the appropriate length. To aid an installer in identifying an appropriate clip 14, a length indicia 34 can be molded or incised on the central portion 32 as depicted in FIG. 4A. Standard thicknesses commonly encountered in poured-concrete and masonry-block walls are 4, 6, 8, 10, and 12 inches.

Figure 5:
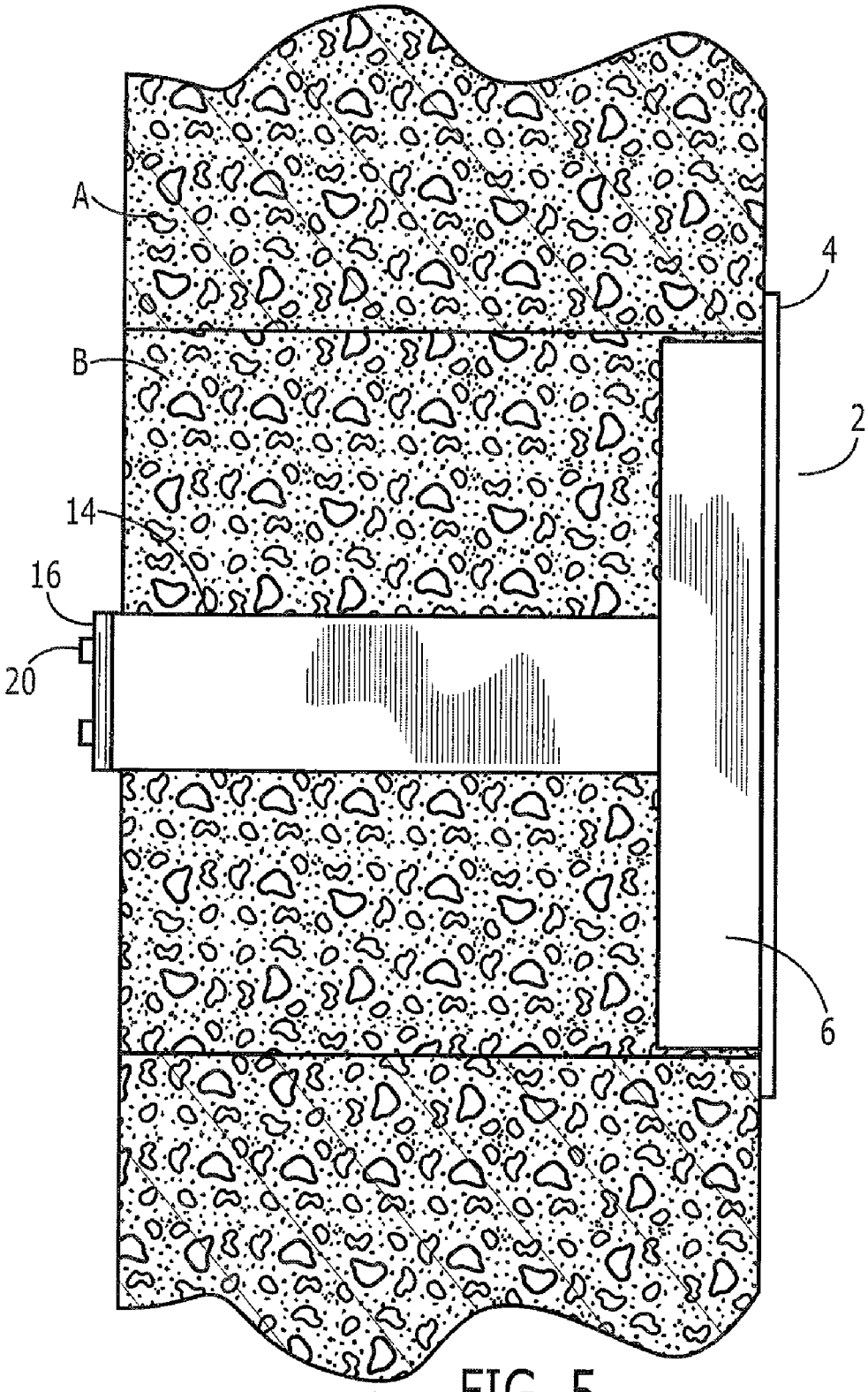
FIG. 5 is a side cutaway view showing the foundation vent installed in a ventilation opening.

FIG. 5 depicts a side view of the foundation vent installed into a foundation wall A having a ventilation opening B. To install the foundation vent, the distal ends 16 of the clips 14 are flexibly pushed in the direction towards each other so that the clips 14 bend at an angle of about 20 degrees away from the unflexed position, which moves the distal ends inwards a sufficient length to clear the edges of the ventilation opening B. The installer inserts the clips partway into said ventilation opening B and releases the clips 14 so that they flex back toward and make a light biased contact with the opposed short faces of the ventilation opening B. The installer then pushes the front frame 2 into the ventilation opening B until the skirt 6 is set within the ventilation opening B and the front flange 4 rests against the exterior face of the foundation wall A. At the moment when the front frame 2 seats against the exterior face of the foundation wall A, the distal ends 16 of the clips 14 will slide past the interior face of the foundation wall A and allow the clips 14 to return to their unflexed position causing the distal ends 16 to rest against the interior face of the foundation wall A and thus securing the foundation vent to the foundation wall A.

Figure 6:
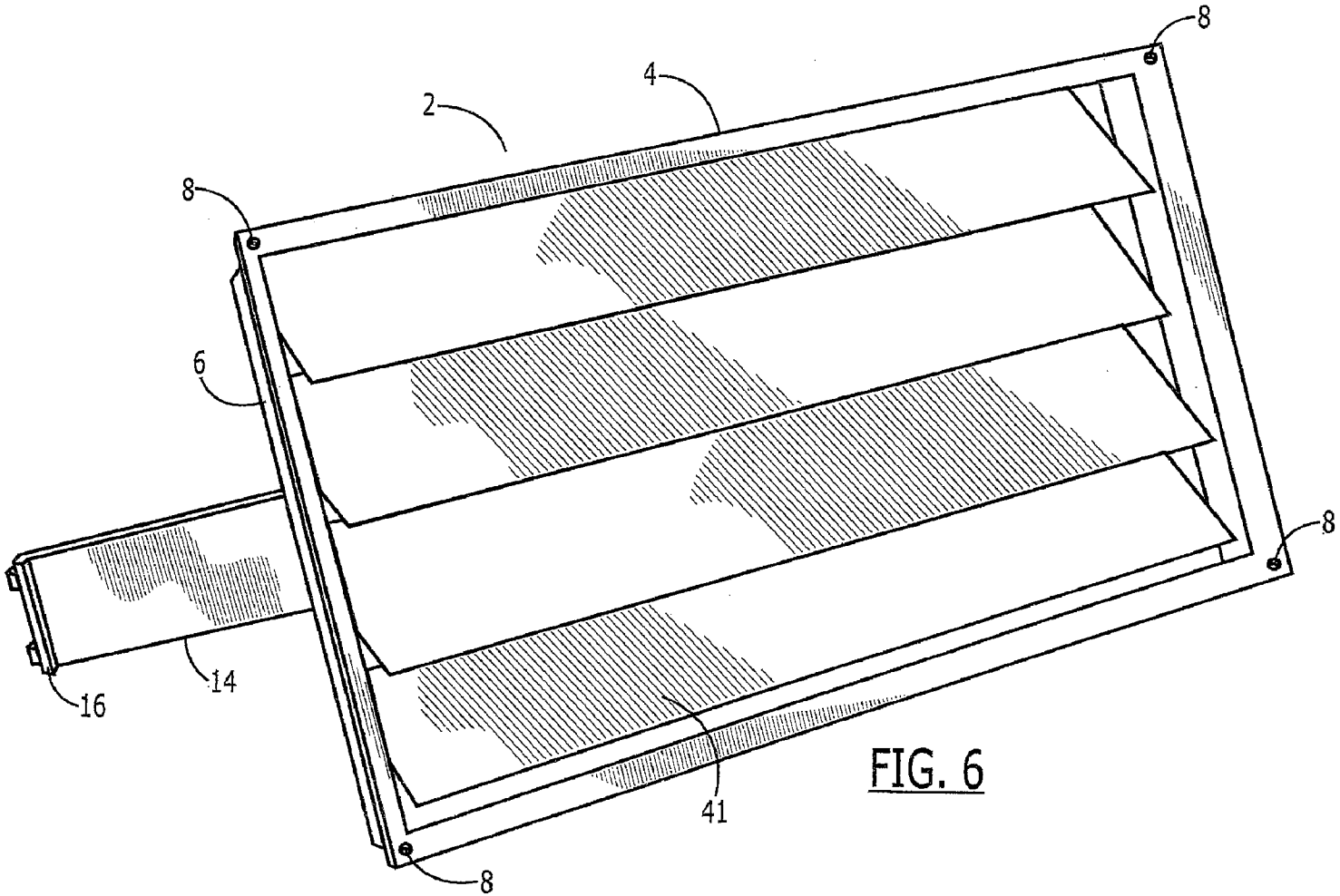
FIG. 6 is a front perspective view of a foundation vent embodying manually-adjustable louvers.
Figure 7:
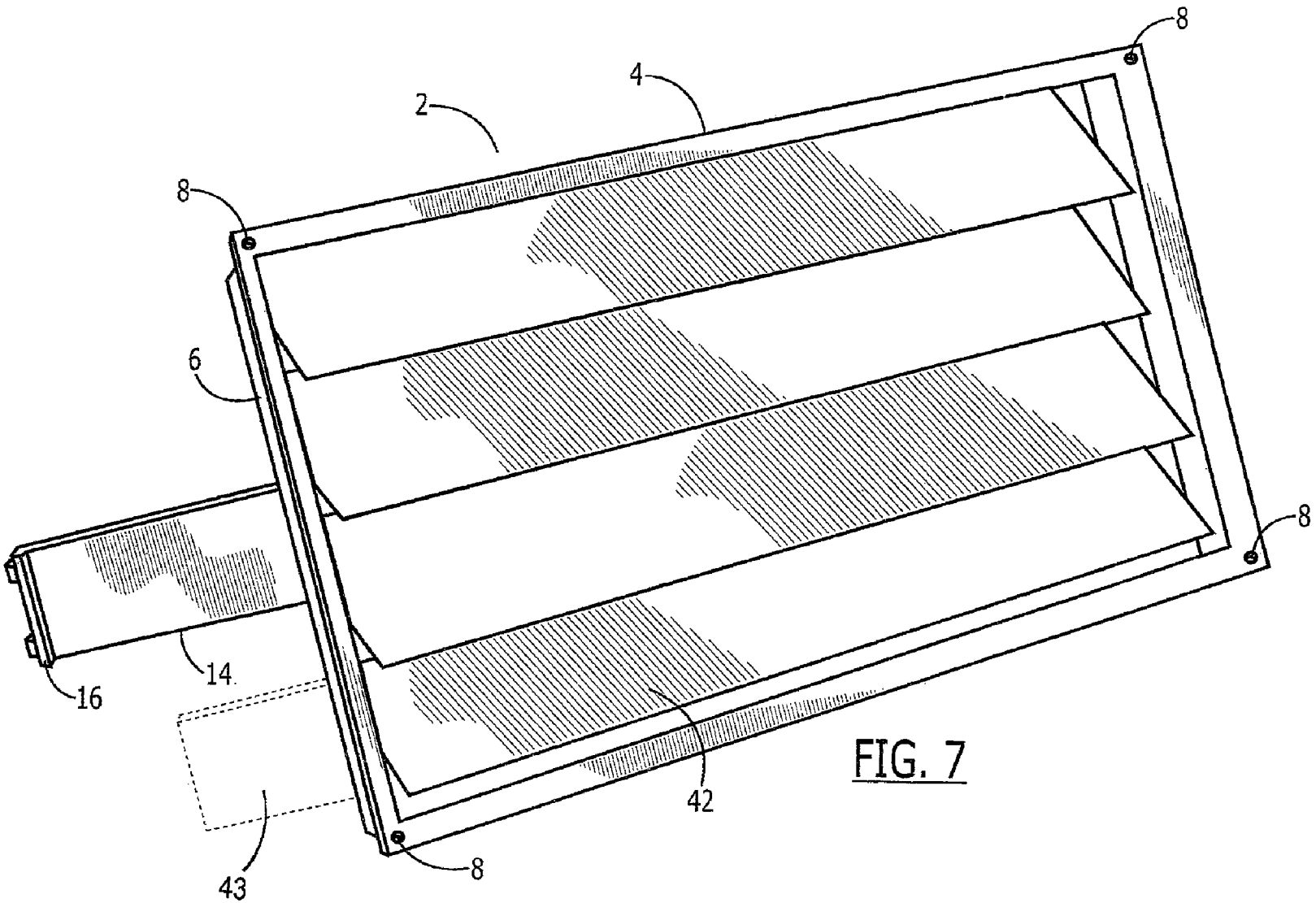
FIG. 7 is a front perspective view of a foundation vent embodying automatic louvers.
Figure 8:
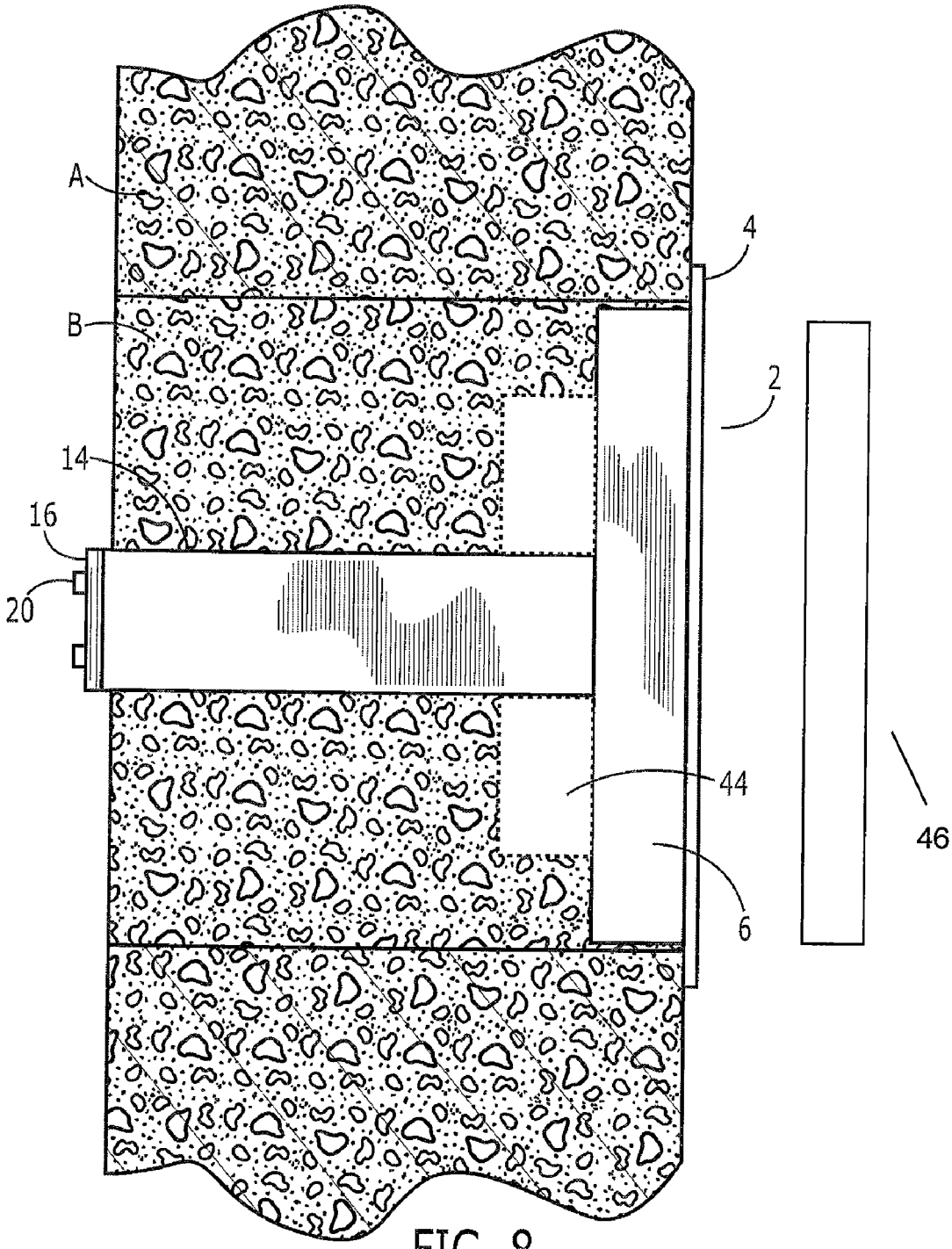
FIG. 8 is a front perspective view of a foundation vent embodying a fan.

It will be apparent to those skilled in the art that various modifications and variations can be made to the present invention without departing from its scope and spirit. For example, the front frame could be modified as shown in FIG. 6 to encompass manually-operated shutters 41 or as shown in FIG. 7 to encompass automatic shutters 42 such as the kind actuated by a bimetallic spring coil 43. Similarly, the front frame could be modified as shown in FIG. 8 to accept a fan 44 to provide forced ventilation of a crawlspace. FIG. 8 also shows the plugging member 46 that can be inserted into the space bounded by the peripheral skirt 6 to seal the front frame during cold weather. In addition, the present invention could be constructed in any shape and used in other applications where it is desirable to have a screened vent installed to cover an opening within a wall. Thus, it is intended that the present invention cover the modifications and variations that come within the scope of the claims and their equivalents.

I claim:

1. A vent for installation into a wall having an exterior face, an interior face with said interior face being parallel to said exterior face, and a wall opening surface with a perimeter dimension, the vent comprising:

(a) a frame for engaging the exterior face of the wall around the wall opening;

(b) said frame having a front surface, a back surface, and at least one vent opening;

(c) said frame further having a continuous peripheral skirt with a proximal perimeter connected to the back surface and a distal perimeter extending from the back surface, said skirt in position to engage the wall opening surface;

(d) said skirt comprising means for screening matter of a predetermined size from passing through each said vent opening, said means positioned away from said proximal perimeter;

(e) at least two clips each having a proximal end, central portion, and distal end, with said proximal ends connected to opposing sides of said frame such that said central portion extends from the back surface of said frame;

(f) said distal ends comprising a tab member that is a set at an angle to said central portion so that said tab members face away from each other;

(g) said clips having an overall length such that when said proximal ends are connected to said frame, said tab members are in a position for engaging the interior face of said wall, said clips are set at a substantially perpendicular angle to the back surface of said frame and said proximal ends of said clips are selectably connectable to said frame by means of slots in which:

a protrusion engages an indentation, each of said clips have one or more ridges that engage a corresponding space in each slot, and said clips having stops that limit the depth to which a clip may be inserted into said slots.

2. The vent of claim 1 further comprising means for covering said vent opening.

3. The vent of claim 1 further comprising means for covering said vent opening comprising a fixed grid.

4. The vent of claim 1 further comprising means for covering said vent opening comprising manually-adjustable louvers.

5. The vent of claim 1 further comprising means for covering said vent opening comprising automatic-adjustable louvers.

6. The vent of claim 1 further comprising a fan.

7. The vent of claim 1 further comprising said frame having an outer perimeter that is larger than the perimeter dimension of said wall opening.

8. The vent of claim 1 further comprising said tabs on said distal ends being set at an angle that is substantially perpendicular to said central portion.

9. The vent of claim 1 further comprising said central portion of said clips being resiliently flexible.

10. The vent of claim 1 further comprising that said proximal ends of the clips are selectably connectable to said frame by insertion into slots.

11. The vent of claim 1 further comprising:

a plugging member for sealing each said vent opening;

said frame having a an outer perimeter that is larger than the perimeter dimension of said wall opening;

said central portion of said clips being resiliently flexible; and said tabs on said distal ends being set at an angle that is substantially perpendicular to said central portion.

12. A vent for installation into a wall having an exterior face, an interior face with said interior face being parallel to said exterior face, and a wall opening with a perimeter dimension, the vent comprising:

(a) a frame for engaging the exterior face of the wall around a wall opening;

(b) said frame having a front surface, a back surface, and at least one vent opening;

(c) said frame comprising means for screening matter of a predetermined size from passing through each said vent opening;

(d) at least two clips each having a proximal end, a resiliently-flexible central portion, and distal end, with said proximal ends connected to opposing sides of said frame such that said central portion extends from the back surface of said frame;

(e) said distal ends comprising a tab member that is a set at an angle to said central portion so that said tab members face away from each other; and are substantially-parallel to the back surface of said frame;

(f) said clips having an overall length such that when said proximal ends are connected to said frame, said tabs are in a position for engaging the interior face of said wall; and (g) said proximal ends of the clips are selectably connectable to said vent, said clips are set at a substantially perpendicular angle to the back surface of said frame and said proximal ends of said clips are selectably connectable to said frame by means of slots in which:

a protrusion engages an indentation, each of said clips have one or more ridges that engage a corresponding space in each slot, and said clips having stops that limit the depth to which a clip may be inserted into said slots.

13. The vent of claim 12 further comprising a plugging member for sealing each said vent opening.

14. The vent of claim 1 in which distance from said tab members to the back surface of said frame is predetermined within the range of 4 to 12 inches.

15. The vent of claim 12 in which distance from said tab members to the back surface of said frame is predetermined within the range of 4 to 12 inches.

* * * * *